United States Patent [19]

Garland

[11] 4,185,467

[45] Jan. 29, 1980

[54] ICEMAKER LIQUID REFRIGERANT DEFROST SYSTEM

[75] Inventor: Milton W. Garland, Waynesboro, Pa.

[73] Assignee: Frick Comany, Waynesboro, Pa.

[21] Appl. No.: 852,763

[22] Filed: Nov. 18, 1977

[51] Int. Cl.[2] ..... F25B 41/00; F25C 5/10

[52] U.S. Cl. ..... 62/81; 62/277; 62/348; 62/352

[58] Field of Search ..... 62/352, 277, 81, 348

[56] References Cited

U.S. PATENT DOCUMENTS

| | | | |
|---|---|---|---|
| 1,051,297 | 1/1913 | Williams | 62/352 |
| 2,663,162 | 12/1953 | Trepaud | 62/352 X |
| 3,053,058 | 9/1902 | Kocher | 62/352 X |
| 3,062,018 | 11/1962 | Baker | 62/352 X |
| 3,280,585 | 10/1966 | Lowe | 62/352 X |

*Primary Examiner*—William F. Pate, III

*Attorney, Agent, or Firm*—Dowell & Dowell

[57] ABSTRACT

A vertical shell and tube icemaker wherein the refrigerant surrounds tubes within which ice is made, and the freezing refrigerant outlet is positioned below the defrost refrigerant outlet to expedite release of ice during defrosting, the system employing liquid refrigerant obtained by continuous flow from the receiver for defrosting. Water is supplied around the upper ends of the tubes for maintaining a vertical stream flow which is distributed around the inner circumference of each tube.

10 Claims, 9 Drawing Figures

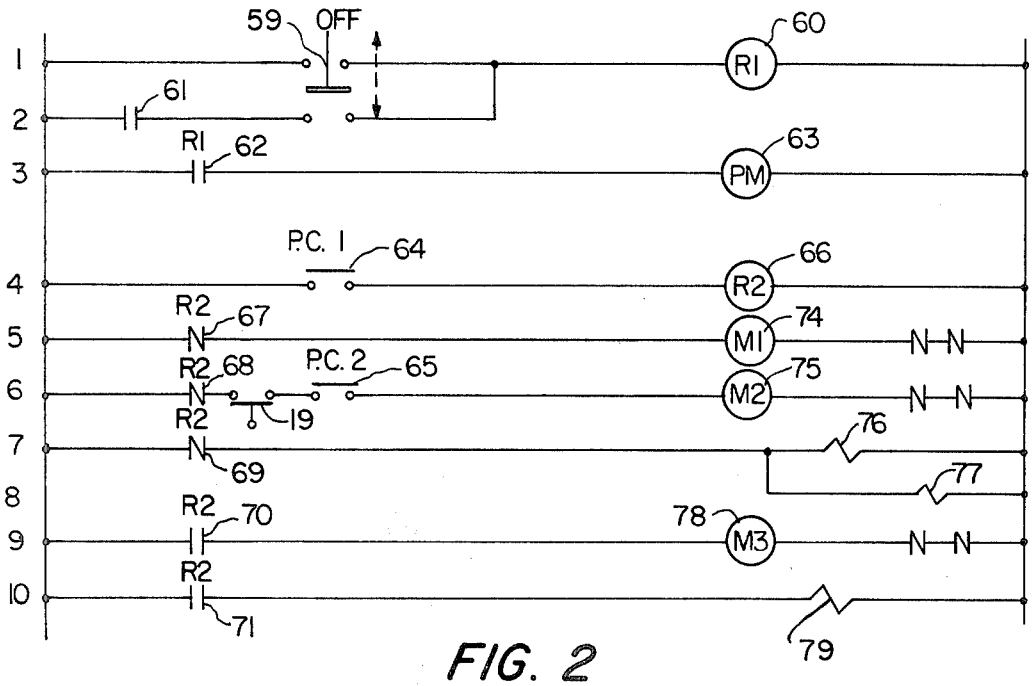
FIG. 2
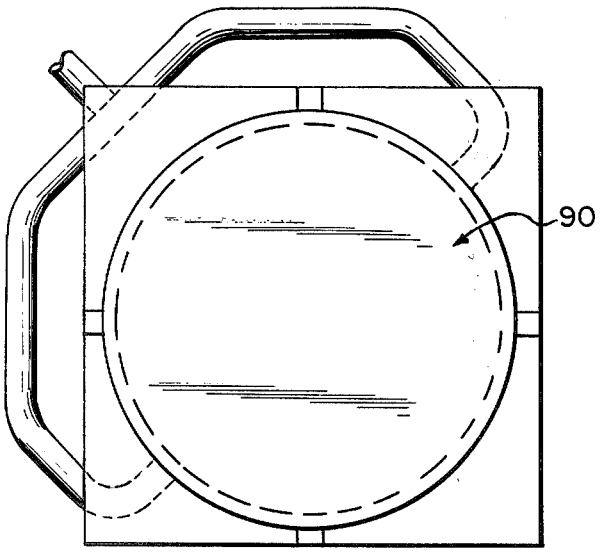
FIG. 3
FIG. 7
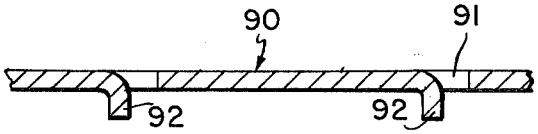
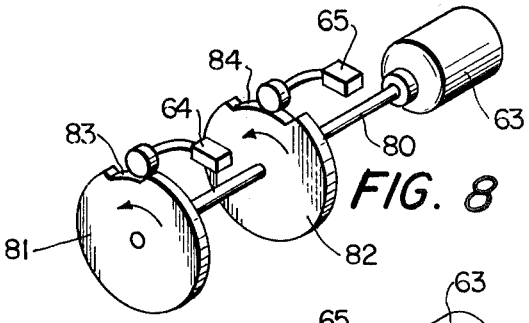
FIG. 8
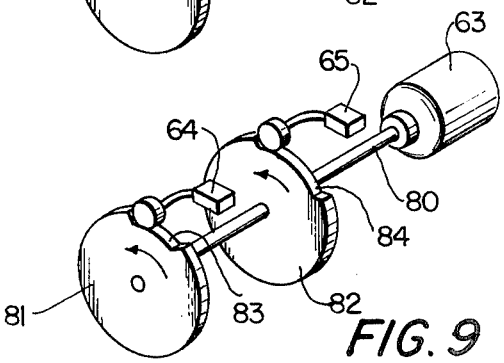
FIG. 9

ICEMAKER LIQUID REFRIGERANT DEFROST SYSTEM

BACKGROUND OF THE INVENTION

1. Field of the Invention

The invention is in the field of refrigeration and, more particularly, of its application to the commercial manufacture of ice in the form of tubes, or rods, which are fragmented during the harvesting operation.

2. Description of the Prior Art

Shell and tube icemakers in the general category under consideration are disclosed in prior art such as Garland U.S. Pat. No. 2,870,612, and Chapman, U.S. Pat. No. 2,739,457.

These differ in various respects from the present invention, including the use of ordinary hot gas for defrosting, instead of liquid refrigerant, the method of distribution of water, and the arrangement of the defrosting refrigerant with respect to the freezing refrigerant in heat exchange relation with the tubes.

Prior art which is of interest with respect to the location of defrosting media includes the patents to Trepaud, U.S. Pat. No. 2,663,162 and 2,749,721, and Wilbushewich, 2,594,529.

Patents which are of interest with respect to the use of liquid refrigerant, although not in similar manner to the present invention, include Wilbushewich U.S. Pat. Nos. 2,594,529, and Trepaud 3,036,443.

Patents which disclose various arrangements for distributing water to ice machines include U.S. Pat. Nos. Burdick, 1,694,370, Gruner, 2,387,899, and Kessler et al, 3,849,232.

SUMMARY OF THE INVENTION

Briefly stated, the invention provides for improved ice-making and thawing for harvesting purposes in a vertical shell and tube icemaker in which ice is made within the tubes. During the freezing cycle, ice forms beyond the level or area of contact of the freezing refrigerant due to the thermal conductivity of the metal enclosure. In conventional practice wherein the defrosting fluid is passed through the same passages as the freezing fluid, a problem is present in freeing the ice which has formed beyond such contact area. The present invention meets this problem by providing a different outlet for the defrosting fluid and which is located above and beyond the outlet used for the freezing refrigerant thereby providing direct heat exchange relation for defrosting purposes and thus avoiding the time delay and other problems which are otherwise present. The avoidance of the time delay permits harvesting to be carried out in less time than would otherwise be required thereby increasing the effective capacity of the apparatus.

It is an object of the invention to improve the harvesting efficiency by employing warm liquid refrigerant for defrosting instead of hot gas as has been conventionally used. By maintaining a sufficient volume of warm liquid refrigerant in the receiver, so that the liquid temperature does not fall below about 65° F., the harvesting cycle may be completed in approximately thirty (30) to sixty (60) seconds. Since liquid has a higher heat content than gas, and uniform flow of a liquid is more easily accomplished over all parts of the heat exchange apparatus than with a gas, the defrost may be carried out in less time than is normally required where hot gas is used for this purpose. Problems which might be anticipated in such a system, including those related to the supply of liquid refrigerant at diverse temperatures, the change from one liquid to the other in the same passages, and the controls therefore, are met by the arrangement of the system, its components, and controls, which will be described.

In order to achieve greater uniformity in ice formation, thereby achieving a more uniform product and in a minimum of time, the invention also includes provision for distributing the water in a vertical stream flow onto the sheet at the upper ends of the tubes, the flow being distributed around the inner circumference of each tube.

The foregoing and other objects of the invention will become apparent from the following description in conjunction with the accompanying drawings.

DESCRIPTION OF THE DRAWINGS

FIG. 2 is a schematic control circuit for the system of FIG. 1;

FIG. 3 is a top plan view of the shell and tube icemaker;

FIG. 7 is an enlarged section on the line 7—7 of FIG. 6;

FIG. 8 is a schematic perspective view of portions of the control mechanism at the beginning of the freezing cycle; and FIG. 9 is a schematic perspective view of the control mechanisms of FIG. 8 at the beginning of the harvest cycle.

DESCRIPTION OF THE PREFERRED EMBODIMENT

Figure 1:
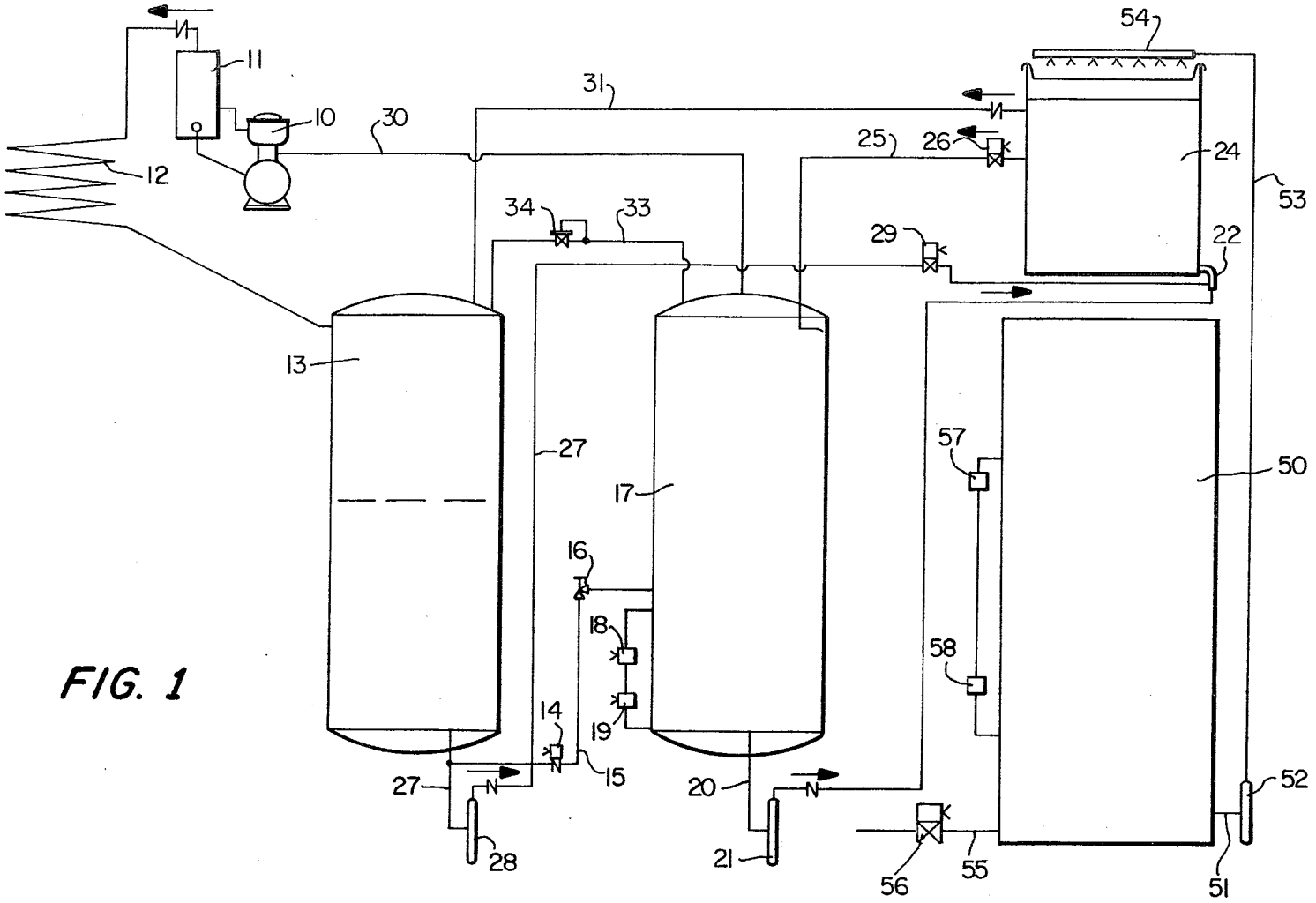
FIG. 1 is a schematic of a refrigeration system embodying the present invention.
Figure 4:
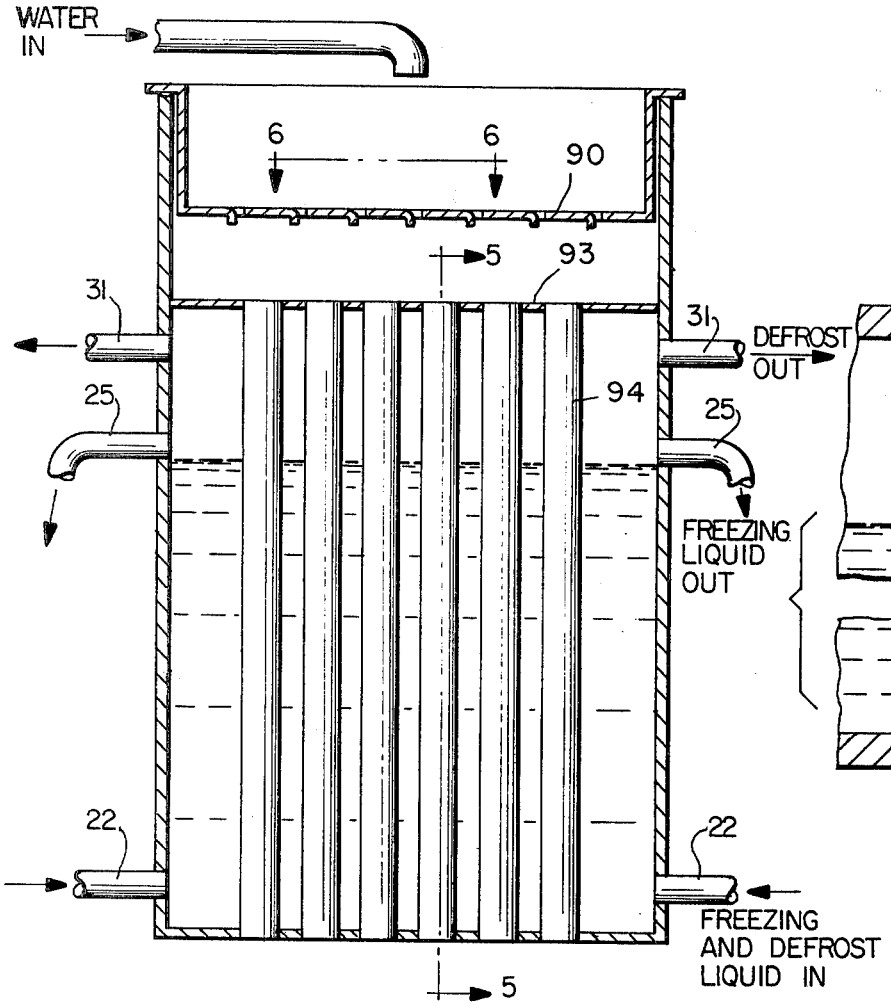
FIG. 4 is a vertical section through the shell and tube icemaker.
Figure 5:
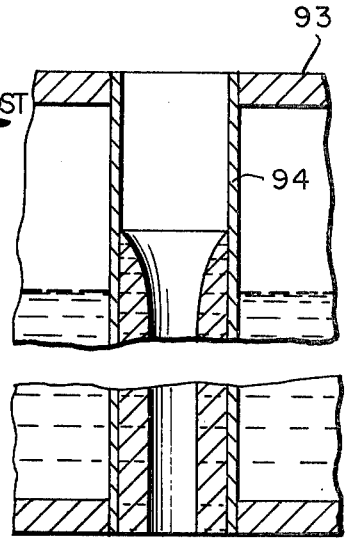
FIG. 5 is an enlarged fragmentary section on the line 5—5 of FIG. 4.
Figure 6:
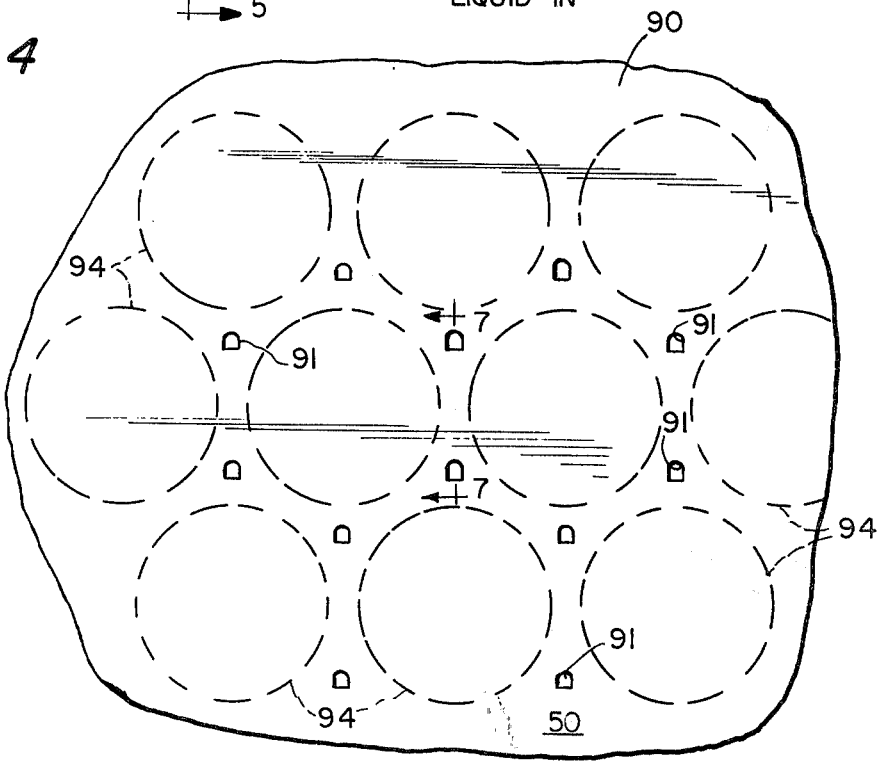
FIG. 6 is an enlarged fragmentary section on the line 6—6 of FIG. 4.

Referring to FIG. 1, the refrigeration system is conventional from the compressor inlet to the receiver. It includes a compressor 10 having an oil trap 11, condenser 12 and receiver 13. The receiver is preferably of a size slightly larger than normal in order to maintain an adequate quantity of relatively warm liquid for defrosting purposes, in addition to that which will be subcooled and used for freezing purposes.

From the receiver, during the freezing phase, the liquid refrigerant flows from the receiver through conduit 15 having a solenoid operated valve 14 and manual rate control valve 16 into the separator-accumulator 17. A predetermined operating level of refrigerant is maintained in the tank 17 by the float control switch 18 which controls the valve 14.

From the tank 17, liquid refrigerant flows through conduit 20 to pump 21 which delivers it to the inlet 22 of the shell and tube icemaker 24. The pump 21 is sized or throttled to deliver slightly more liquid refrigerant than is evaporated in the icemaker 24. From the icemaker 24, the liquid and gaseous refrigerant is returned to tank 17 through return pipe 25 having solenoid operated valve 26 therein.

Associated with the tank 17 and the float switch 18 is a float safety switch 19 which is operative to stop operation of pump 21 in the event of a low liquid level, thereby avoiding damage to the pump due to cavitation. Gaseous refrigerant from the separator-accumulator tank 17 returns to the compressor through suction line 30.

After a predetermined length of freezing time, during which ice is formed within the tubes 74, defrosting operations begin. Defrosting is accomplished by closing solenoid operated valve 26 in the return pipe 25 and solenoid operated valve 14 between the receiver 13 and the separator-accumulator 17 and pumping liquid refrigerant from the receiver through branch line 27 and pump 28 through solenoid operated valve 29 which is now open into the inlet 22 of the icemaker.

At the beginning of the defrosting cycle, pump 28 is at condensing pressure and the icemaker is at suction pressure, thus no problem of loss of prime of pump 28 occurs when its operation is started. From icemaker 24, the liquid refrigerant is returned to the receiver through line 31, whose connection to the icemaker 24 is located above that of the pipe 25.

A sufficient volume of warm liquid refrigerant is maintained in the receiver so that in the exchange of heat for bringing the icemaker to a temperature of 45° F. for harvesting, the liquid temperature in the receiver 13 does not fall below about 65° F. The cylinders of ice that are harvested may be fragmented or handled by any desired means such as that disclosed in my U.S. Pat. No. 2,870,612.

At the end of the harvest portion of the cycle and the beginning of the next icemaking phase, the icemaker 24 will be filled with warm liquid refrigerant which will immediately drain when the solenoid valve 26 in line 25 is reopened. Since it is desirable to avoid any direct heat exchange and thereby limit any icemaking in the tubes above the suction outlet level of the pipe 25, it may be advisable to delay the start of the pump 21 for, say, twenty to forty seconds to permit draining to the level of pipe 25. This may be accomplished as will be described later.

At the start of refreezing, pump 21 will be at suction pressure, and the pressure within the icemaker will be relieved down to suction pressure. Thus, the warm liquid that has filled the icemaker will flash to the temperature and pressure of the suction side of the system. Pump 21 will, therefore, begin operation at a minimal pressure difference between its inlet and outlet.

For maintaining a desired minimum pressure in the separator-accumulator 17, a conduit 33 is provided having a pressure differential operated valve 34 therein which can be preset to the desired level.

Water for icemaking may be recirculated from a suitable container 50 having an outlet 51 to water pump 52 which pumps water through supply line 53 to the supply pan 54. Makeup water may be supplied through pipe 55, having solenoid operated valve 56, which is controlled in any conventional manner as by upper and lower float operated switches 57 and 58.

With reference to FIG. 2, an electrical control system for the system described, is illustrated. Item 59 in lines 1 and 2 is a switch shown in the off position which prevents icemaking. When in the upper or manual position the control mechanism of the icemaker is operable for service purposes only. When in the lower or auto position, the icemaker is automatically in operation, if the compressor to which it is connected is in operation, the contacts 61 in line 2 being a part of the compressor motor control and closed only when the compressor motor is running. In this latter position relay R1, 60 in line 1 is energized and thus closes the contacts R1, 62, line 3. This energizes the program motor PM, 63. The program motor remains continually in operation when the icemaker is in service. This program motor 63 revolves the shaft 80 and the cams 81, 82 which operate microswitches PC1, 64 line 4 and PC2, 65 line 6 whose sequence of operations will be described presently.

Line 4 also includes relay R2, 66, which operates relay contacts in line 5 through 10 inclusive, numbers 67, 68, 69, 70 and 71 respectively, relay contacts 67, 68 and 69 being closed when relay 66 is de-energized and relay contacts 70 and 71 being open when relay 66 is de-energized.

Line 5 also includes motor M1, 74, for water pump 52. Line 6 includes motor M2, 75, for cold liquid refrigerant recirculating pump 21. Line 7 includes coil 76 for solenoid operated valve 26 so that refrigerant is discharged from the icemaker 24 through the line 25 during the freezing cycle. Line 8 includes coil 77 for solenoid operated valve 14 in refrigerant line 15 so that refrigerant flows from the receiver 13 into the separator-accumulator tank 17 while refrigerant is being pumped from such tank 17 during the freezing cycle. Line 9 includes motor M3, 78, which drives warm liquid refrigerant pump 28 in line 27 during the harvest cycle. Line 10 includes coil 79 which opens solenoid operated valve 29 in line 27 to permit warm refrigerant to flow into the icemaker 24 during the harvest cycle.

As an example of operation of the system, the nominal overall cycle may run twelve minutes for an average refrigerant temperature of 8° F., making ice that is approximately 5/16-inch thick. The time would be less if a lower average refrigerant temperature were used and greater if a higher average refrigerant temperature were used.

With reference to FIG. 8, the program motor 63 drives a shaft 80 on which a pair of cams 81 and 82 are fixed and such cams control the operation of microswitches 64 and 65, respectively. The cam 81 has a reduced peripheral portion 83 of a length correlated to the time for harvest which, in this example, is equal to approximately one twelfth of the circumference of the cam 81. The cam 82 has a reduced peripheral portion 84 of a selected length. Since it is desirable to stop the pump 21 at the same time that the pump 28 commences to pump warm refrigerant into the icemaker during the harvest cycle and since it is desired to delay starting the pump 21 after the pump 28 has stopped, the reduced peripheral portion 84 is of a length equal to the length of the cam portion 83 plus a distance necessary to delay operation of the pump 21. Accordingly, it is noted that the cam 82 is selected in accordance with the desired time delay period. Further, both of the cams, 81 and 82, are selected in accordance with the temperature of the refrigerant in the system.

After the predetermined delay mentioned above, switch 65 is closed, thereby energizing motor 75 for pump 21, subject to possible cutting off by safety switch 19, as previously described.

With particular reference to FIG. 9, after a predetermined period of operation, approximately eleven minutes, program motor 63 has rotated the shaft 80 to a position such that both switches 64 and 65 open, thereby reversing the operations described above. Thus, relay 66 in line 4 will reverse the condition of contacts 67 through 71, respectively, in order to cease operation of pumps 52 and 21 and commence operation of pump 28.

At the end of the harvesting phase, the pressure within the icemaker will be substantially that of the condenser, with refrigerant at approximately 45°-50° F. When the system is changed to the freezing phase, the refrigerant (assuming R-22) will flash down to a pressure corresponding to 32° F., approximating 57.47 psig. The excess liquid refrigerant in the system is removed through the line 25.

With particular reference to FIGS. 4 through 7, the water for freezing is brought in at the top of the icemaker above the tubes into a pan-like structure 90. This has punched drip lip type openings 91 which are so located that the water is guided by the lips 92 and falls onto the top head end 93 of the shell and tube icemaker at spaces located around each tube, six having been found to be an effective number. The spacing and arrangement of the drip lip opening 91 maintains a series of vertical streams downwardly against the head 93, and these streams, in turn, flow evenly downwardly around the inner circumference of each of the tubes 94.

I claim:

1. In a refrigeration system having compressing and condensing means, a liquid refrigerant receiver, and evaporator means, in which the evaporator means is in heat exchange relation with water in the frozen or unfrozen state in an icemaker and which water is frozen and harvested cyclically, the improvement comprising, a separator-accumulator, first warm liquid supply means connecting the receiver for fluid flow to said separator-accumulator, said evaporator having inlet and outlet means, second warm liquid supply means connecting the receiver to an inlet of the evaporator means for passing the liquid refrigerant from the receiver into heat exchange relation with the ice to be harvested in the icemaker, first and second valve means in said first warm liquid supply and said second warm liquid supply connecting means for selectively opening or closing said connecting means, means connecting said separator-accumulator to an inlet means of said evaporator means for supplying relatively cool liquid refrigerant to said evaporator means in heat exchange relation with the water to be frozen in the icemaker, first return means connecting an outlet of said evaporator means to said separator-accumulator, said separator-accumulator connected to the suction of said compressing means, second return means connecting an outlet of the evaporator means to said receiver, and valve means controlling flow through said first return means.

2. The invention of claim 1, in which the outlet of the evaporator means which is connected by the first return means to the separator-accumulator is positioned substantially below the elevation of the outlet of the evaporator means which is connected by the second return means to the receiver, whereby during the time that the ice is harvested the relatively warm liquid refrigerant is in direct heat exchange relation with ice that has been frozen in the icemaker including that which is above the elevation of the outlet of the evaporator means which is connected to the first return means.

3. The invention of claim 1, and flow rate control means in the first warm liquid supply means.

4. The invention of claim 1, and liquid level responsive means in said separator-accumulator, said liquid level responsive means controlling the operation of the first valve means in said first warm liquid supply means.

5. The invention of claim 1, and pump means in the means connecting the separator-accumulator outlet to said evaporator means.

6. The invention of claim 5, and liquid level responsive means in said separator-accumulator, said liquid level responsive means connected to said pump means and operative to terminate its operation in the event that the liquid level responsive means indicates a predetermined low level.

7. The invention of claim 1, and pump means in the means connecting the receiver to the evaporator means.

8. The invention of claim 1, said icemaker having vertical tube means, means for flowing water to be frozen down the inner sides of said tube means, and means for passing the liquid refrigerant for freezing or harvesting, respectively, up the outer sides of said tube means.

9. In a refrigeration system having compressing and condensing means, a liquid refrigerant evaporator, and evaporator means, in which the evaporator means is in heat exchange relation with water in the frozen or unfrozen state in an icemaker and which water is frozen and harvested cyclically, the improvement comprising, a separator-accumulator, means connecting the receiver for fluid flow to said separator-accumulator, said separator-accumulator connected to supply liquid refrigerant to the evaporator and to receive refrigerant from the evaporator, said receiver connected to supply refrigerant to the separator-accumulator and to receive refrigerant from the evaporator, said separator-accumulator connected to the suction of said compressing means, whereby during the freezing cycle relatively cool liquid refrigerant from the separator-accumulator may be supplied to the evaporator and whereby during the harvesting cycle relatively warm liquid refrigerant from the receiver may be supplied to said evaporator and the relatively cool refrigerant from the evaporator returned to said receiver, said receiver of a size to accommodate a sufficient supply of warm refrigerant to accomplish defrosting during the harvesting cycle.

10. A shell and tube icemaker comprising a housing, upper and lower head plates located in spaced relationship to each other within said housing, a plurality of vertical tubes extending between said upper and lower head plates and being open at both ends, the upper ends of said tubes extending no higher than the upper surface of said upper head plate, means for introducing cold refrigerant fluid into said housing between said upper and lower head plates and into heat exchange relationship with said vertical tubes during a freezing phase, means for introducing defrosting fluid into said housing between said upper and lower head plates and in heat exchange relationship with said tubes during a harvesting phase, a reservoir located within said housing, said reservoir including a bottom wall located above and in spaced generally parallel relationship with said upper head plate, said bottom wall having a plurality of spaced openings, each of said openings being located above a portion of said upper head plate between said vertical tubes, and means for introducing liquid to be frozen into said reservoir, whereby the liquid to be frozen streams through said openings in said bottom wall during the freezing phase onto the upper head plate only and liquid from several streams flows into each tube and is distributed evenly over the inner periphery of each tube so that the ice formed therein is of substantially equal thickness.

* * * * *